US006024489A

United States Patent [19]

Fox et al.

[11] Patent Number: 6,024,489

[45] **Date of Patent: *Feb. 15, 2000**

[54] PRODUCE BAG WITH IMPROVED STRENGTH AND LOADING FEATURES

[75] Inventors: Kenneth S. Fox; L. Keith Fox, both of McAllen, Tex.

[73] Assignee: Kenneth Fox Supply Company, McAllen, Tex.

[ * ] Notice: This patent is subject to a terminal disclaimer.

[21] Appl. No.: 09/212,169

[22] Filed: Dec. 16, 1998

Related U.S. Application Data

[63] Continuation-in-part of application No. 09/174,435, Oct. 16, 1998.

[51] Int. Cl.[7] ..... B65D 30/06

[52] U.S. Cl. ..... 383/9; 206/554; 383/117

[58] Field of Search ..... 383/9, 117; 204/554

[56] References Cited

U.S. PATENT DOCUMENTS

| | | |
|---|---|---|
| 1,822,948 | 9/1931 | Armstrong . |
| 1,906,500 | 5/1933 | Twitchell . |
| 2,085,365 | 6/1937 | Israel . |
| 2,128,658 | 8/1938 | Millett . |
| 2,428,266 | 9/1947 | Danels . |
| 2,646,203 | 7/1953 | Brady . |
| 2,774,402 | 12/1956 | Wikle . |
| 2,853,225 | 9/1958 | Bauer . |
| 2,952,397 | 9/1960 | Doyle . |
| 3,123,279 | 3/1964 | Day . |
| 3,257,915 | 6/1966 | Cartier et al. . |
| 3,279,511 | 10/1966 | Griffin, Jr. . |
| 3,554,368 | 1/1971 | Nagel . |
| 3,721,603 | 3/1973 | Takeda . |
| 3,733,024 | 5/1973 | Bolling, Jr. . |
| 3,967,544 | 7/1976 | Brock et al. . |
| 4,002,519 | 1/1977 | Mosley et al. . |
| 4,207,983 | 6/1980 | Wolske . |
| 4,301,961 | 11/1981 | Rodish . |
| 4,386,924 | 6/1983 | Crawford et al. . |
| 4,403,637 | 9/1983 | Sabater et al. . |
| 4,451,249 | 5/1984 | DeBin . |
| 4,491,217 | 1/1985 | Weder . |
| 4,566,927 | 1/1986 | Wood . |
| 4,832,677 | 5/1989 | Hudgens et al. . |
| 4,881,933 | 11/1989 | Wech . |
| 4,883,450 | 11/1989 | Benoit . |
| 4,889,523 | 12/1989 | Sengwald . |
| 4,974,968 | 12/1990 | Mandus et al. . |
| 4,988,213 | 1/1991 | Mattle ..... 206/554 |
| 5,294,148 | 3/1994 | Imai . |
| 5,417,638 | 5/1995 | Anderson et al. . |
| 5,571,361 | 11/1996 | Stuerzel . |
| 5,741,076 | 4/1998 | Cammack . |
| 5,823,683 | 10/1998 | Antonacci et al. . |

FOREIGN PATENT DOCUMENTS

| | | |
|---|---|---|
| 837421 | 6/1960 | United Kingdom . |

OTHER PUBLICATIONS

"FD–35V High–speed, center press–seal, automatic bag making machine"[online], Totani Corp., 1997, [retrieved on 1999–07–12]. Retrieved from the Internet:<URL:www.totani.co.jp/English/E_SC/E_FDFA/eFDF35.htm.

*Primary Examiner*—Stephen P. Garbe
*Attorney, Agent, or Firm*—Bracewell & Patterson, L.L.P.

[57] ABSTRACT

A produce bag has one side wall of a cross-laminated synthetic resin fabric mesh material. The bag offers increased strength and reliability when used with automatic bag filling equipment. The mesh material forms a rear wall of the bag when a group of the bags are placed on wicket pins of the equipment for receiving produce. The front or forward wall is of a synthetic resin film. A reinforcing strip of synthetic resin film is formed along an upper portion of a mesh material wall of the bag where spaced holes for wicket pin attachment are formed. The reinforcing strip extends below the forward wall into the interior of the bag space formed between the front and rear walls. The bag provides greater strength, uniformity, and reliability in automatic produce packing machine operations.

19 Claims, 6 Drawing Sheets

PRODUCE BAG WITH IMPROVED STRENGTH AND LOADING FEATURES

CROSS-REFERENCE TO RELATED APPLICATIONS

The present application is a continuation-in-part of prior co-pending U.S. patent application Ser. No. 09/174,435, filed Oct. 16, 1998.

FIELD OF THE INVENTION

The present invention relates to wicket-top produce bags, and more particularly to bags adapted for automatic produce packing machines.

BACKGROUND OF THE INVENTION

Wicket produce bags have been developed for automatic produce packing machines. One portion of the bag has holes formed in it so that the bags can be suspended from wickets or pegs on an automatic packing machine. The earliest such bags were of polyethylene film.

Produce bags formed of a synthetic resin fabric mesh have been recently developed by the assignee of the present application, for example as described in co-pending U.S. patent application Ser. No. 08/888,175, filed Jul. 3, 1997. These bags were formed of a synthetic resin fabric mesh, such as the woven fabric of cross-laminated synthetic resin fibers known as Cross Laminated Airy Fabric or (CLAF) from Amoco Fabrics & Fibers, Inc. This fabric is an open mesh material of cross-laminated warp and weft strands or fibers of synthetic resin.

These types of bags are particularly useful for produce that must have access to fresh air to preserve the shelf life of the produce. However, when wicket holes are formed in this type of fabric mesh for automatic produce bag filling or packing machine purposes, problems have been found to occur. Slits were formed in the mesh in the area of the wicket holes leading away from the holes. The slits were formed in order to aid in tearing of the bag away from the packing machine once the bag was filled with product.

When the fabric mesh was slit for this purpose near the wicket holes, only a certain number of synthetic resin fiber strands in the fiber mesh were left uncut. The remaining uncut fiber strands were the sole support for the bag when it was suspended from the wicket rods or pegs and being filled with product. The number of strands left uncut was variable and indeterminate, and the reliability of the bags for use in automatic packing machines suffered. Bags with too many strands cut did not have adequate strength for use and would fall from the wickets during filling operations. Faulty bags could slow up operation of automatic packing machines by falling from the wickets when being filled with produce.

BRIEF SUMMARY OF THE INVENTION

Briefly, the present invention provides a new and improved wicket-top synthetic resin bag for use with wicket pins of automatic bag filling or packing equipment. The bag is formed of first and second side walls which are joined together along a bottom portion and two side edges. One of the side walls is formed from a cross-laminated synthetic resin fiber material mesh, such as a CLAF material or the like. The wall of mesh material forms a back or rear wall of the bag when placed on wicket pins of the equipment for product filling. The front or forward walls is formed of a synthetic resin film, such as polypropylene or polyethylene or the like. The fiber mesh side wall of the bag has a reinforcing strip of synthetic resin film extending along an upper edge. A wicket top is formed in the reinforcing strip for mounting the bag on the wicket pins of the bag packing machine or equipment. The reinforcing strip extends below the forward wall into the space formed between the front and rear walls. If desired, the rear wall bag may also be provided with a lower support strip of synthetic resin film. The front and rear side walls are sealed along a bottom or lower edge of the bag, forming a three layer bonded seam of increased strength. Bags according to the present invention exhibit greater strength in use during filling operations and are thus more reliable.

BRIEF DESCRIPTION OF THE DRAWINGS

The objects, advantages and features of the invention will become more apparent by reference to the drawings appended thereto, wherein like numerals indicate like parts and wherein an illustrated embodiment of the invention is shown, of which.

DETAILED DESCRIPTION OF PREFERRED EMBODIMENT

Figure 1:
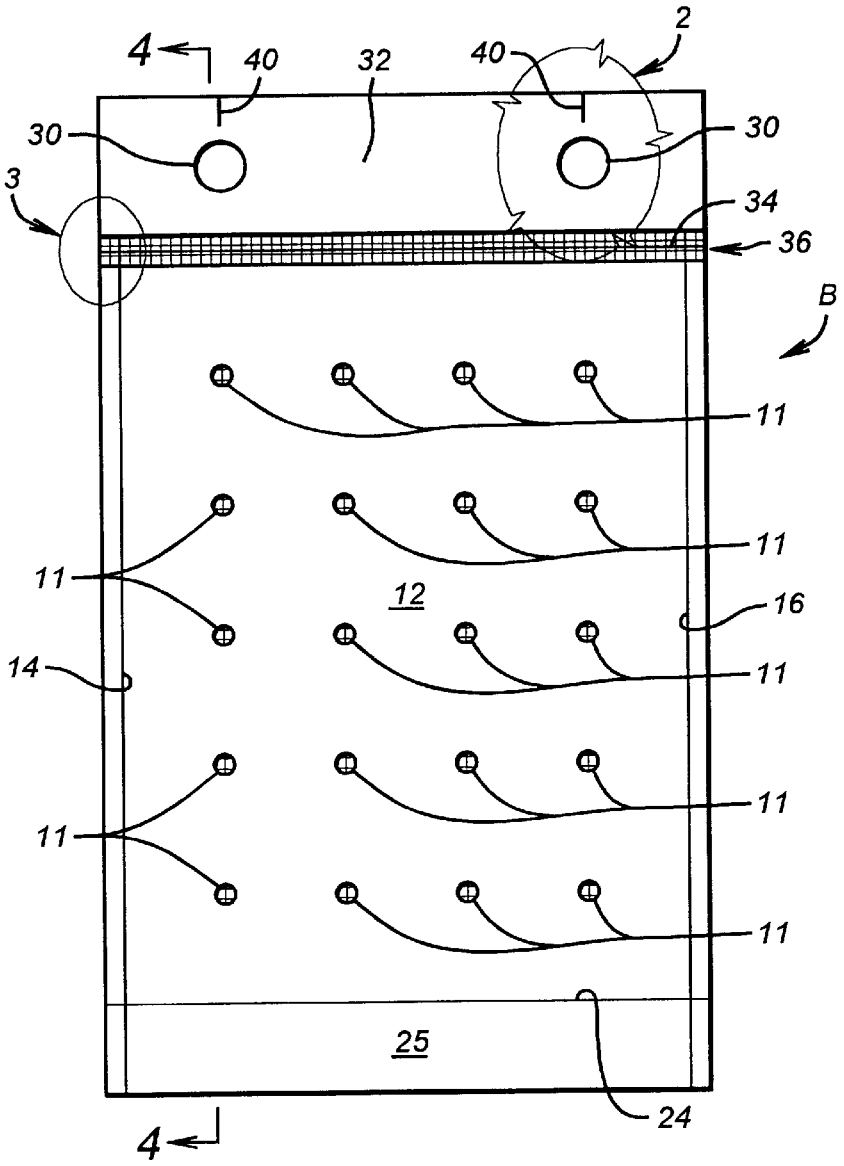
FIG. 1 is a front elevation view of a produce bag according to the present invention.
Figure 2:
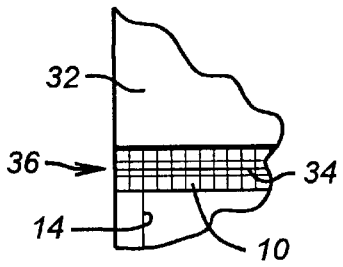
FIG. 2 is an enlarged view of a portion of the bag of FIG. 1 encircled and having reference numeral 2 indicating same.
Figure 3:
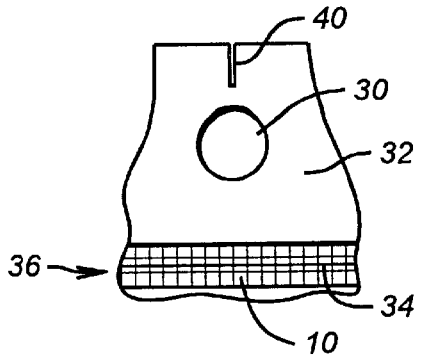
FIG. 3 is an enlarged view of a portion of the bag of FIG. 1 encircled and having reference numeral 3 indicating same.

In the drawings, the letter B designates generally a wicket-top synthetic resin bag according to the present invention. The bag B is specifically adapted for use with wicket pins of commercially available automatic produce bag filling equipment. The following chart is a list of examples of bag filling equipment for which bags according to the present invention may be used:

| SOURCE | MODEL |
|---|---|
| Ag-Pak, Inc. | Double Ag-Pak Weigh/Bagger |
| Ag-Pak, Inc. | Octopak Rotary Bagger |
| Ag-Pak, Inc. | Mega Pak Bagger. |
| Yakima Wire Works | MBU/9300 Automatic Poly Bagger |
| Spang & Brands | Automatic Weigher/Bagger |
| Automatic Bagging Systems, Inc. | Vindicator Bagger |
| Lockwood Packing Corp. | Carousel Bagger |
| Volm Bag Co. | VP10 & VP12 with carousel bagger |

Figure 6:
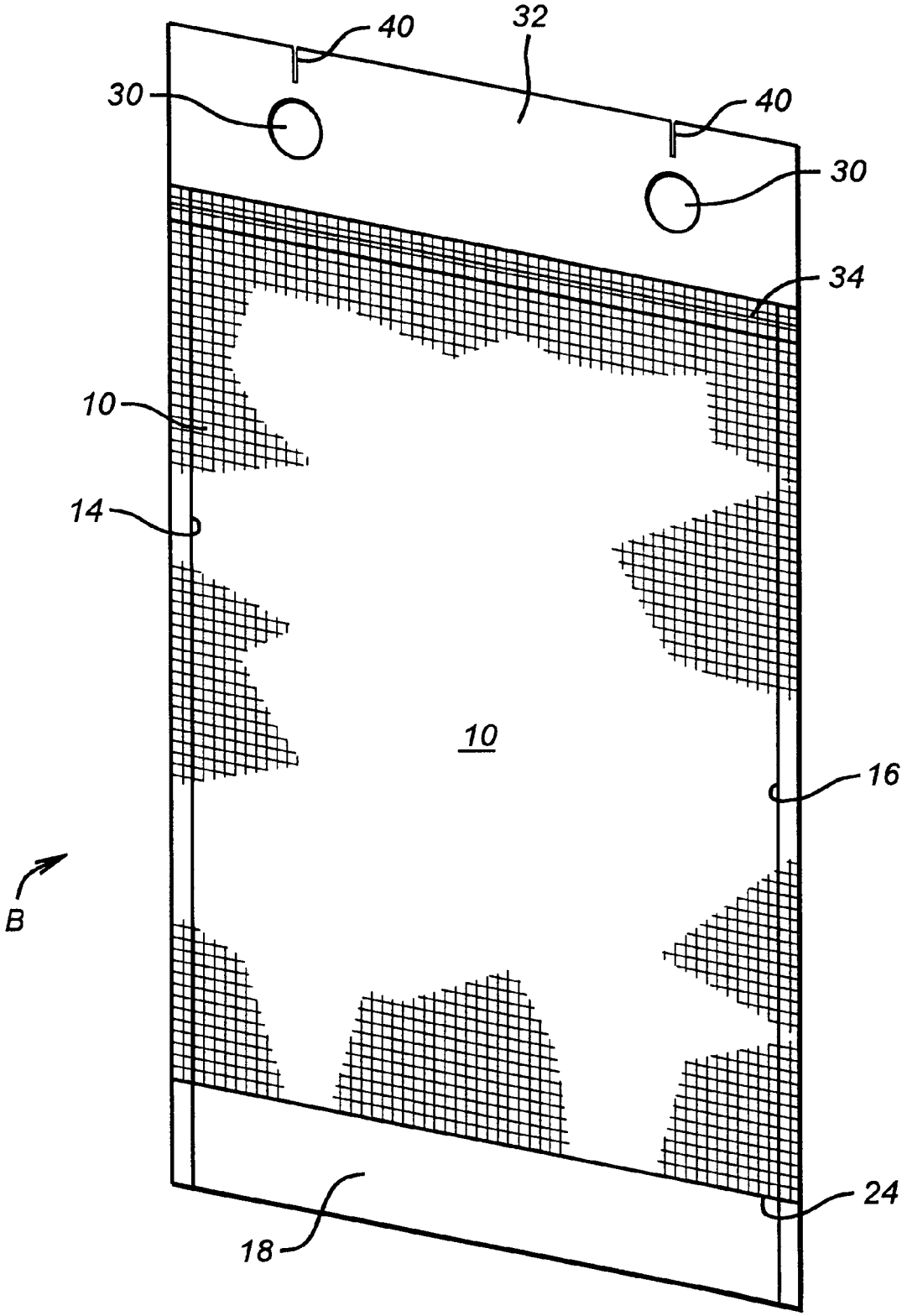
FIG. 6 is an isometric view of the bag of FIG. 1, taken from an opposite direction to that of FIG. 5.

The bag B has a first side wall 10 (FIG. 6), which is formed of a suitable synthetic resin fiber mesh. One type of such a mesh is the cross-laminated airy fabric material, or CLAF, available from Amoco Fabrics & Fibers, Inc. This type of fiber mesh or fabric is an open mesh material of cross-laminated warp and weft strands or fibers of a suitable synthetic resin.

A second side wall 12 of the bag B in the preferred embodiment is a suitable synthetic resin film, such as polyethylene or polypropylene, numerous types of which are commercially available. An example film is 2.25 mil MDPE with an EVA additive. Air or breather holes 11 may be formed in film 12, if desired. It should be understood that the second side wall 12 may also be alternatively formed of the same or similar open mesh cross-laminated material as the side wall 10, if desired.

With the present invention, the side wall 10 is a rear wall of the bag B and the side wall 12 is a front or forward wall. The bag B is placed in groups or sets on wicket pins of automatic filling equipment to receive and be filled with produce. As will be set forth below, the resin film wall 12 faces outwardly or to the front, ahead of the mesh wall 10, when properly installed.

The particular horizontal and vertical dimensions of the side walls 10 and 12, as well as their thickness, are determined based on the expected weight and size of produce to be packed into the bag B by automatic produce packing machinery. The chart below gives example sizes for bags intended for various produce weights:

| PRODUCE WEIGHT | BAG WALL DIMENSIONS |
|---|---|
| 2 pounds | 10 inches by 16 inches |
| 3 pounds | 10.5 inches by 16 inches |
| 5 pounds | 10.5 inches by 19 inches |
| 10 pounds | 13 inches by 23 inches |

For bags of these sizes, the reinforcing strip, discussed in more detail below, is typically 1.5" or so in height.

The bags B may be formed by hand or machines and preferably formed by machine. A suitable type of such machine has been manufactured by Hudson-Sharp Machine Co. of Green Bay, Wis.

The side walls 10 and 12 are bonded or sealed to each other along vertically extending side seams as indicated at 14 and 16. The joining of side walls 10 and 12 at the seams 14 and 16 may be done by any suitable bonding or sealing technique, such as heat, glue, sealant, or the like.

Figure 4:
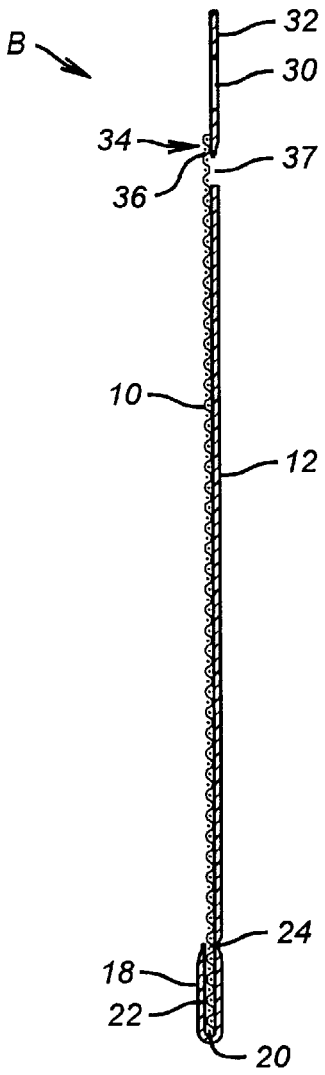
FIG. 4 is a cross-sectional view taken along the lines 4—4 of FIG. 1.

The second side wall 12 has a lower extension 18 (FIGS. 4 and 6) somewhat longer in vertical extent than the first side wall 10. The extension 18 is folded over a lower edge 20 (FIG. 4) of the first side wall 10. The extension 18 is then caused to lay against and extend upwardly along an outer surface 22 of the side wall 10 a suitable length depending on factors chosen by the produce packer.

The extension 18 may be several inches or so, providing an area 25 to which advertising or nutritional value information may be applied and displayed. If the area 25 is not needed, the extension 18 may be much smaller. In some situations, if desired, the extension 18 need not be present, and the side walls 10 and 12 joined by a seam at their lower edges.

When the extension 18 is present, three superimposed layers are formed (FIG. 4), two outer layers composed of the material of the second side wall 12, and an inner layer formed of the mesh material of the first side wall 10. The three superimposed layers of the side walls 10 and 12 are joined together, as indicated at 24 along a lower or bottom seam by bonding or sealing in the same manner as seams 14 and 16, described above.

Figure 4A:
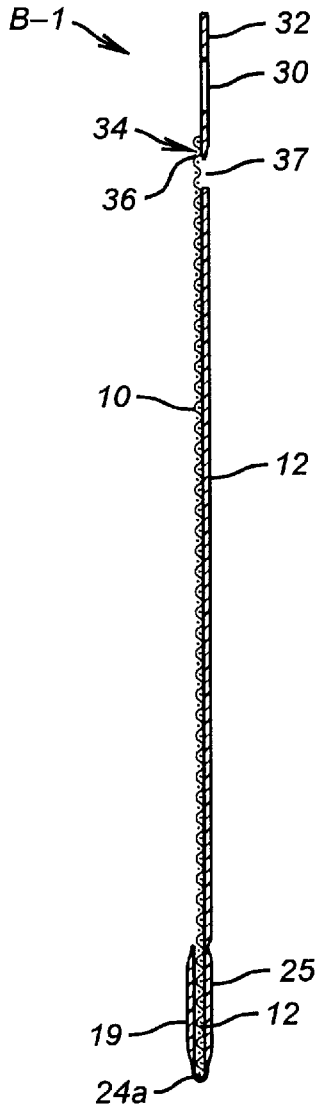
FIGS. 4A and 4B are cross-sectional views of alternative bags taken along the same line in those bags as that in FIG. 4.
Figure 6A:
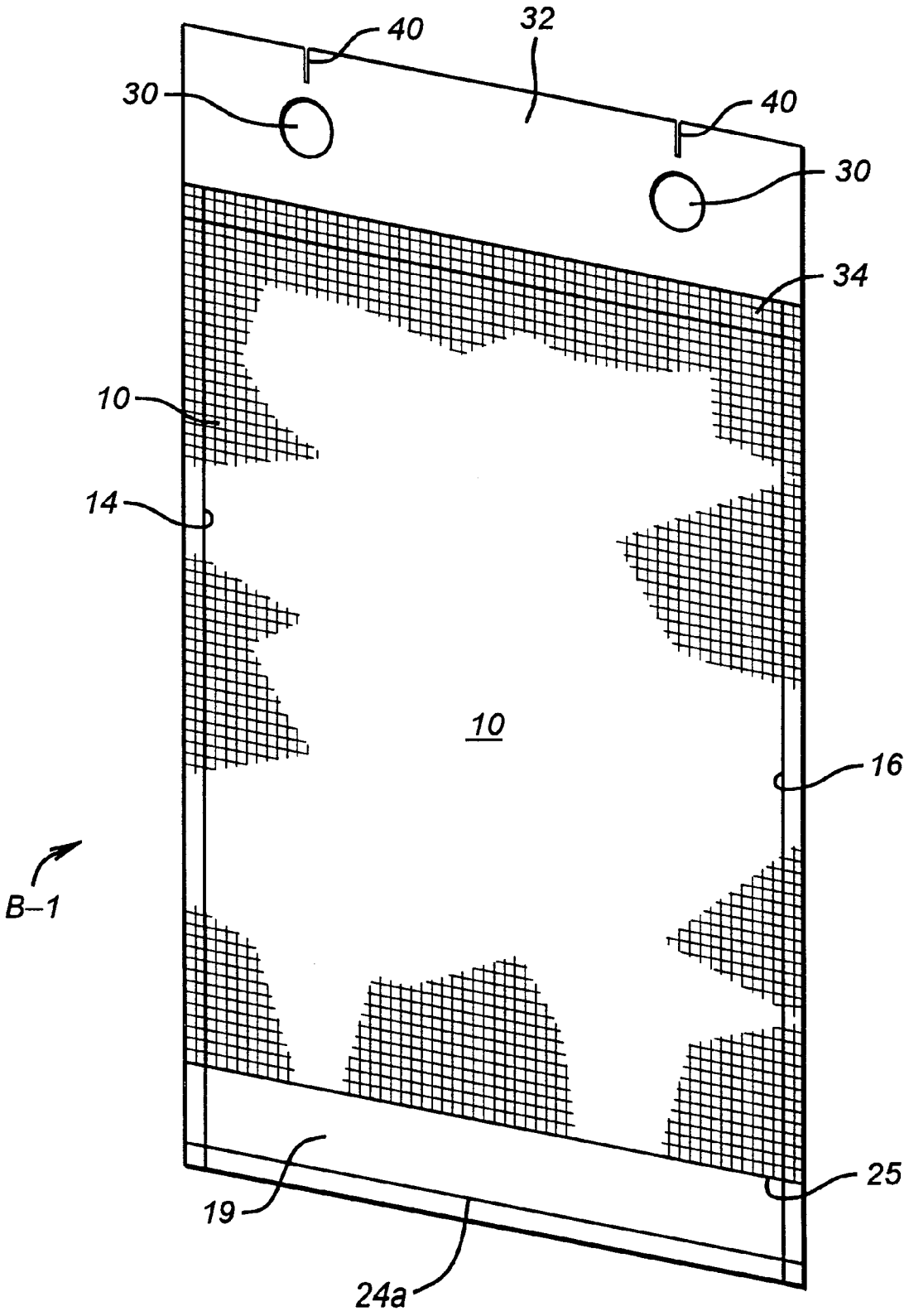
FIG. 6A is an isometric view of the bag of FIG. 4A.

In an alternative embodiment bag B-1 (FIGS. 4A and 6A) like structure to that of the bag B bears like reference numerals. The features of bag B-1 shown in FIGS. 4A and 6A are those different from those of the bag B. The remaining structure of the bag B-1 like that of the bag B. In the bag B-1, a separate lower support strip 19 of synthetic resin film of the type used for side wall 12 is used in place of the extension 18. The support strip 19 is usually of several inches in height and is attached, bonded or sealed along side portions in the same manner along seams 14 and 16. The support strip 19 is also of a surface area capable of receiving advertising, nutritional or other information. In addition, the strip 19 and walls 10 and 12 are bonded or sealed in a three layer bonded seam 24*a* into three superimposed layers (FIG. 4A). The separate resin film strip 19 may, if desired, also be bonded or sealed along an upper strip as shown at 25 to the rear side wall 10, although this is not required.

In the bag B-1, the three-layer bonded seam 24*a* permits bonding of the resin film strip 19 to the resin film of side wall 12 along the width of its lateral extent. This forms a film-to-film bond between the films of strip 19 and side wall 12, affording a reinforced strength bottom seal along the bottom of bag B-1. This additional strength is a particular advantage for bags intended to hold heavier produce weights, such as the ten pound sizes or larger.

The bag B is provided with a suitable number, usually at least two, of laterally aligned wicket holes 30 for suspension in an automatic produce packing machine so that the bag B may be filled with produce or product. The size of the wicket holes 30 is based upon the produce packing machine with which the bags B are to be used. A typical size of wicket hole 30 is one-half inch or so, for example.

According to the present invention, a reinforcing strip 32 of a suitable synthetic resin film is bonded or sealed, as indicated at 34 across a laterally extending seam at an upwardly extending portion 36 of the mesh material of the first side wall 10. The reinforcing strip 32 is located near a gap 37 where produce is introduced into the bag by the produce packing machine.

Joining of the strip 32 to the side wall 10 at the seam 34 may be done in accordance with the bonding or sealing techniques previously described. The synthetic resin film of the reinforcing strip 32 may be of the same or similar synthetic resin material as the second side wall 12. The thickness and strength of the resin material of the strip 32 is selected according to the size of the bag B, as well as the weight of the produce to be packed into it.

Figure 4B:
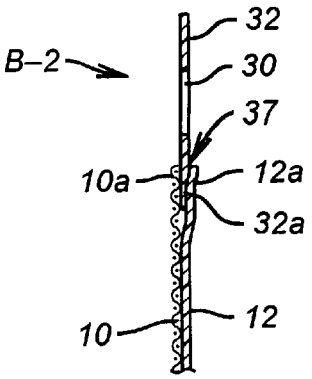
Figure 5:
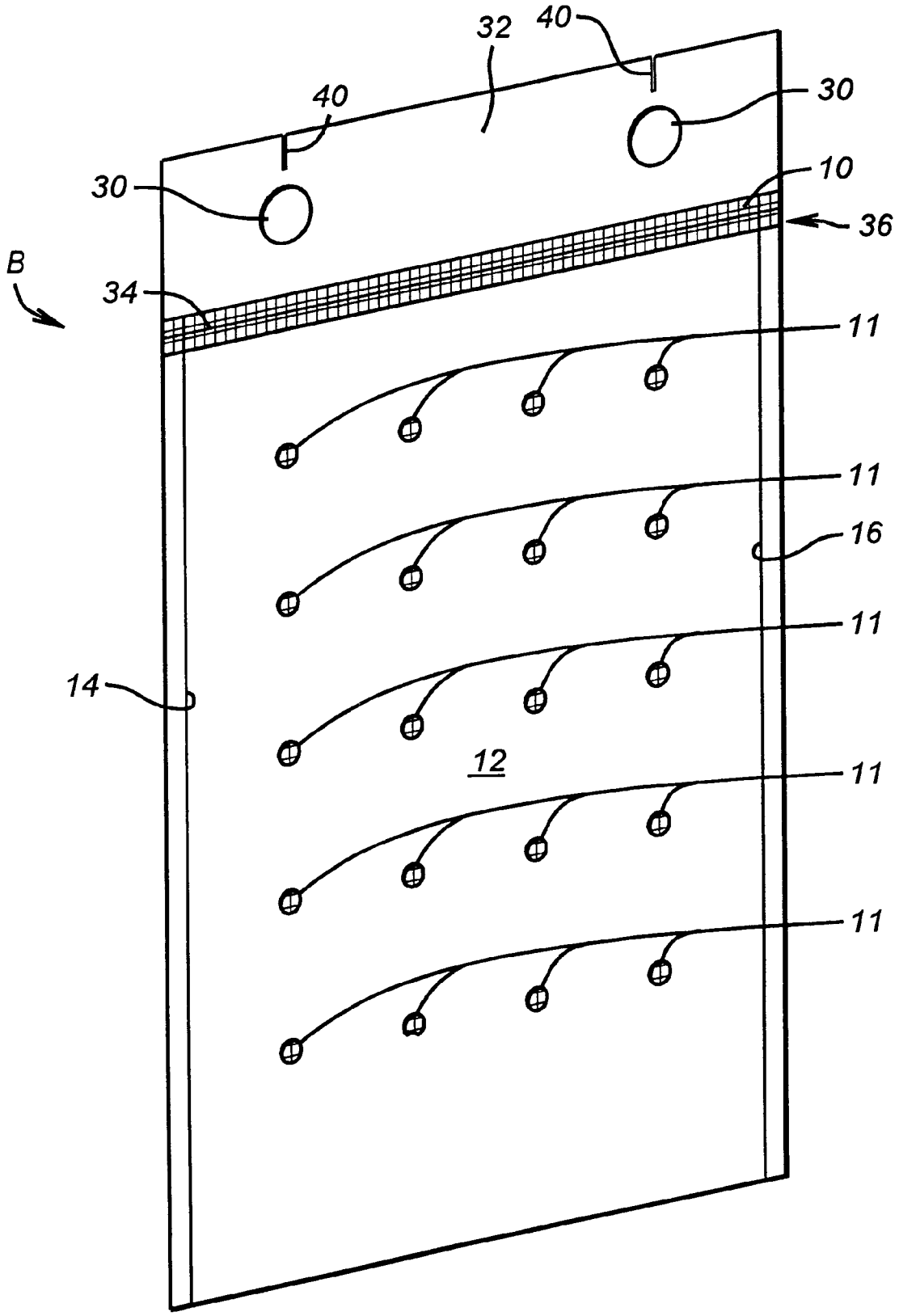
FIG. 5 is an isometric view of the bag of FIG. 1.
Figure 5A:
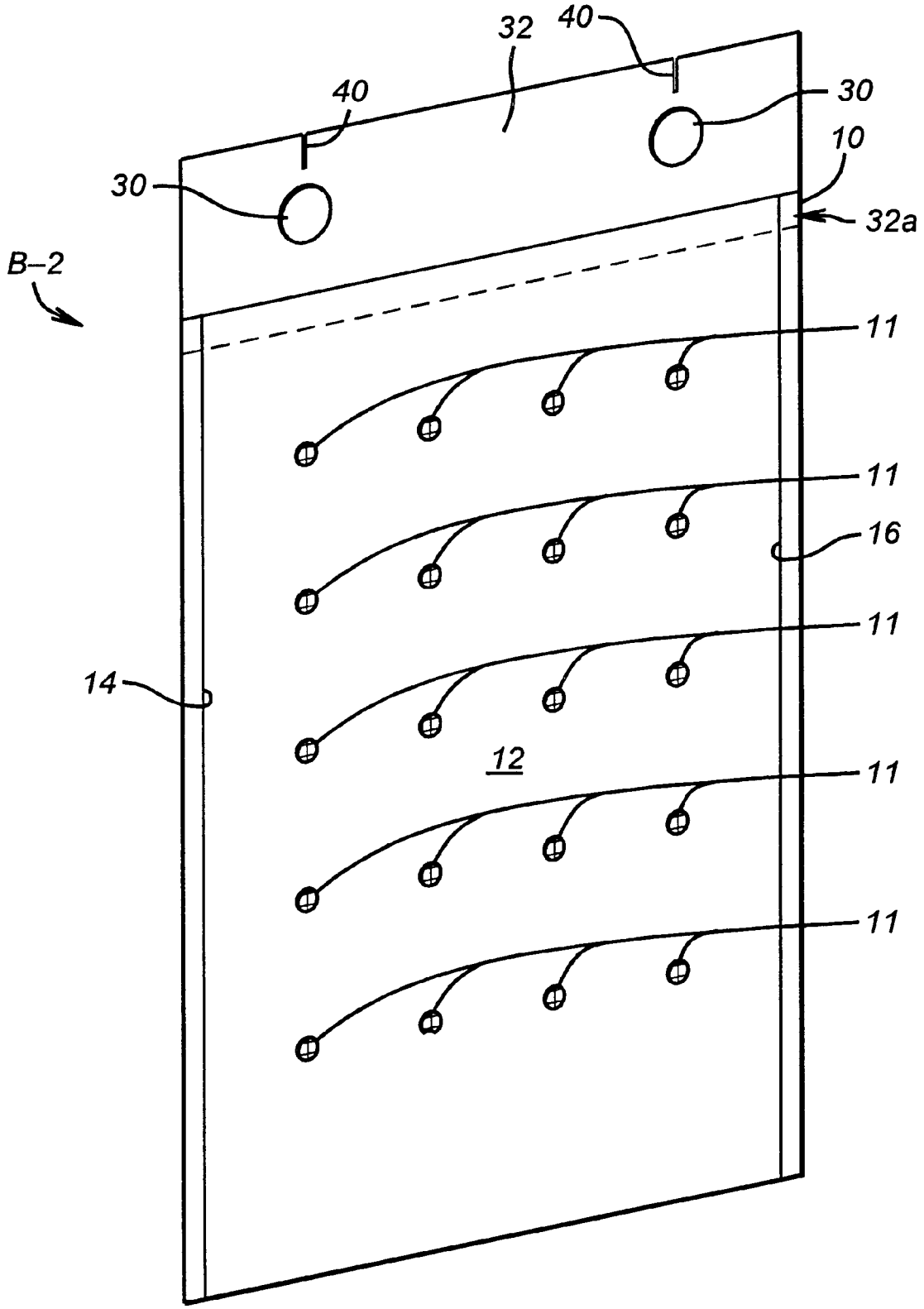
FIG. 5A is an isometric view of the bag of FIG. 4B.

A bag B-2 (FIG. 4B and 5A) shows a structural feature of the reinforcing strip 32 which is adapted for either of bags B or B-1. The lower portions of bag B-2 are not shown, but they may be of like structure to either the bag B or the bag B-1. As shown in FIG. 4B, the reinforcing strip 32 may be of a sufficient vertical extent so that an elongate inwardly extending border or lip 32*a* is formed. The lip 32*a* extends inwardly along upper portions 10*a* of the side wall 10 and an adequate dimension, usually at least one-half inch into the bag B or B-1, below a top lip 12*a* of the side wall 12. This additional portion added of reinforcing strip 32*a* affords a greater surface area of mesh to film bond between the mesh of side wall 10 and the film of reinforcing strip 32. This offers increased strength in the bond at the top of the bag.

The wicket reinforcing strip 32 of bags B and B-1 may also be provided with leaders, or cuts, 40 (FIGS. 5 and 5A) extending inwardly downwardly from an upper edge 42 opposite the seam 34 in the strip 32. The leaders 40 assist in removal of the bag B from the wicket pins in the packing machine once the bag B is filled. It is to be noted that the leaders or cuts 40 are not formed in the mesh material of the first side wall 10 and are also not formed extending from the wicket holes 30. This location of the leaders 40 affords further increased strength and reliability in the bag B over wicket bags formed completely of fabric mesh.

Another advantage of the bags B and B-1 of the present invention is the location of the mesh side wall 10. The mesh side wall 10 is, as noted previously, is a rear bag wall when the bags are installed on wicket pins of the packing equipment. The front film side wall 12 thus faces forwardly on the produce packing machine to receive produce through the gap 37 at the top below reinforcing strip 32.

Figure 4C:
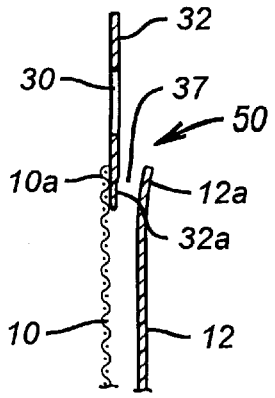
FIG. 4C is a view of the bag of FIG. 4B partially open to be packed with produce.

In a number of packing machines, the bag walls are partially separated as indicated at 50 (FIG. 4C) either by blown air or suction to enlarge the top gap 37 for filling purposes. With the film side wall 12 on the front or forward face on the machine the separating suction forces or bursts of air act on the enlarged surface area of the forward film side wall 12 rather than on the rear mesh wall portion 10. This opens the bags and greatly facilitates use of the bags B and B-1 in packing machines due to the top gap 37 being enlarged for receipt of produce during packing.

From the foregoing, it can be seen that bags are provided which exhibit greater reliability during packing in automatic produce packing machines. The bags offer increased strength in holding produce and are more easily opened for filling. The bags exhibit better capability of staying on the wickets of the machines as produce is being packed. The bags of the present invention are also less likely to suffer from bag material tearing or failure during loading. Space can also be provided with extensions 18 or support strip 19 for inclusion of advertising or nutritional value information.

Having described the invention above, various modifications of the techniques, procedures, material, and equipment will be apparent to those in the art. It is intended that all such variations within the scope and spirit of the appended claims be embraced thereby.

We claim:

1. A synthetic resin bag for use with wicket pins of automatic bag filling equipment, comprising:

a rear wall formed from a synthetic resin fiber mesh;

a front wall formed of a synthetic resin film;

the front and rear walls being joined together along their vertical extent to form side edges to form the bag;

said rear synthetic resin fiber mesh wall having a reinforcing strip of synthetic resin film mounted therewith extending along an upper edge; and said reinforcing strip having holes formed therein for mounting the bag on the wicket pins of the bag filling equipment.

2. The bag of claim 1, wherein the synthetic resin film is polyethylene.

3. The bag of claim 1, wherein the synthetic resin film is polypropylene.

4. The bag of claim 1, further including:

a synthetic resin film support strip attached alone upper portions thereof to a lower portion of the synthetic resin fiber mesh side wall.

5. The bag of claim 1, further including said reinforcing strip having slits formed therein at a location along an upper edge thereof and extending downwardly therefrom at locations spaced laterally from the holes in the reinforcing strip to allow for removal of the bag from the filling equipment.

6. The bag of claim 1, further including:

the synthetic resin film having a downward extension which is folded upwardly to enclose a lower portion of the synthetic resin fiber mesh side wall.

7. The bag of claim 1, wherein the rear wall reinforcing strip has a lip formed thereon extending below an upper edge of the front wall.

8. The bag of claim 1, wherein the rear wall reinforcing strip has a lip formed thereon extending below an upper edge of the front wall between the front and rear walls.

9. A synthetic resin bag for use with wicket pins of automatic bag filling equipment, comprising:

first and second side walls joined along a bottom portion and two side edges to form the bag;

the first side wall being formed from a synthetic resin fiber mesh;

the second side wall being formed of a synthetic resin film;

a synthetic resin film support strip attached to a lower portion of the synthetic resin fiber mesh side wall;

said synthetic resin fiber mesh side wall having a reinforcing strip of synthetic resin film extending along an upper edge; and said reinforcing strip having holes formed therein for mounting the bag on the wicket pins of the bag filling equipment.

10. The bag of claim 9, wherein the synthetic resin film is polyethylene.

11. The bag of claim 9, wherein the synthetic resin film is polypropylene.

12. The bag of claim 9, further including said reinforcing strip having slits formed therein at a location along an upper edge thereof and extending downwardly therefrom at locations spaced laterally from the holes in the reinforcing strip to allow for removal of the bag from the filling equipment.

13. A synthetic resin bag for use with wicket pins of automatic bag filling equipment, comprising:

first and second side walls joined along a bottom portion and two side edges to form the bag;

one of the side walls being formed from a synthetic resin fiber mesh;

the other of the side walls being formed from a synthetic resin film and having an upper lip extending between the two side edges;

said synthetic resin fiber mesh side wall having a reinforcing strip of synthetic resin film mounted therewith extending along an upper edge of the mesh side wall;

said reinforcing strip having a portion extending below the upper lip of the synthetic resin film side wall; and said reinforcing strip having holes formed therein for mounting the bag on the wicket pins of the bag filling equipment.

14. The bag of claim 13, wherein the synthetic resin film is polyethylene.

15. The bag of claim 13, wherein the synthetic resin film is polypropylene.

16. The bag of claim 13, further including:

the synthetic resin film having a downward extension which is folded upwardly to enclose a lower portion of the synthetic resin fiber mesh side wall.

17. The bag of claim 13, further including a synthetic resin film strip attached to a lower portion of the synthetic resin fiber mesh side wall.

18. The bag of claim 13, further including said reinforcing strip having slits formed therein at a location along an upper edge thereof and extending downwardly therefrom at locations spaced laterally from the holes in the reinforcing strip to allow for removal of the bag from the filling equipment.

19. The bag of claim 13, wherein:

the mesh side wall is formed on a rear side of the bag; and the resin side wall is formed on a front side of the bag.

* * * * *